United States Patent [19]

Amstutz

[11] Patent Number: 4,991,368

[45] Date of Patent: Feb. 12, 1991

[54] WALL SYSTEM

[75] Inventor: Douglas D. Amstutz, Muskegon, Mich.

[73] Assignee: Amstore Corporation, Muskegon, Mich.

[21] Appl. No.: 294,242

[22] Filed: Jan. 6, 1989

[51] Int. Cl.[5] ..... E04B 2/60

[52] U.S. Cl. ..... 52/241; 52/126.4; 52/238.1; 52/282; 52/716; 52/770

[58] Field of Search ..... 52/241, 242, 243, 239, 52/238.1, 282, 126.4, 126.7, 716, 727, 728, 766, 770, 475, 476, 771

[56] References Cited

U.S. PATENT DOCUMENTS

| | | | |
|---|---|---|---|
| 3,125,193 | 3/1964 | Brown et al. | 52/242 |
| 3,603,049 | 9/1971 | Pierce | 52/241 |
| 3,608,258 | 9/1971 | Spratt | 52/241 |
| 3,755,979 | 9/1973 | Pantazi | 52/241 |
| 4,028,855 | 6/1977 | Prewer | 52/238.1 |
| 4,030,260 | 6/1977 | Sukolics et al. | 52/238.1 |
| 4,361,994 | 12/1982 | Carver | 52/241 |
| 4,574,547 | 3/1986 | Menchetti et al. | 52/238.1 |
| 4,635,756 | 1/1987 | Sherwood et al. | 52/282 |

FOREIGN PATENT DOCUMENTS

| | | | |
|---|---|---|---|
| 276869 | 8/1965 | Australia | 52/241 |

*Primary Examiner*—Michael Safavi

*Attorney, Agent, or Firm*—Warner, Norcross & Judd

[57] ABSTRACT

A wall system for partitioning floor space includes a framework comprising top and bottom horizontal rails interconnected by a plurality of vertical struts. The wall system further includes the use of diagonal support bars for open frame structures and the use of side and septum display panels for closed frame structures. Additionally, various types of snap-on covers are provided for removably covering the vertical struts. Also, anchoring devices including hook and loop type fastener sheets and adhesive are used to secure the bottom rail against lateral shifting.

36 Claims, 8 Drawing Sheets

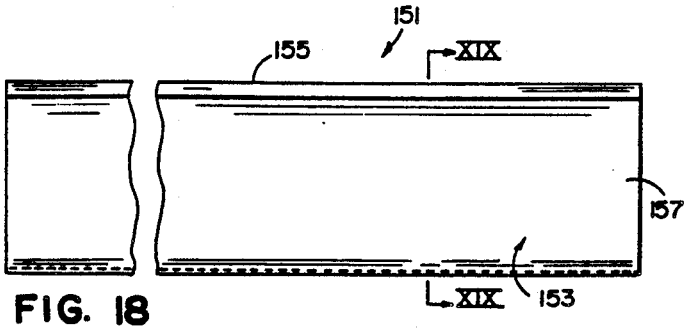
FIG. 18
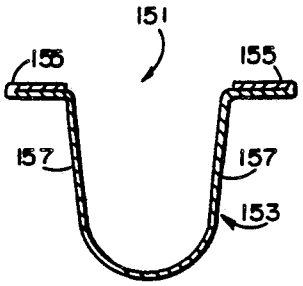
FIG. 19
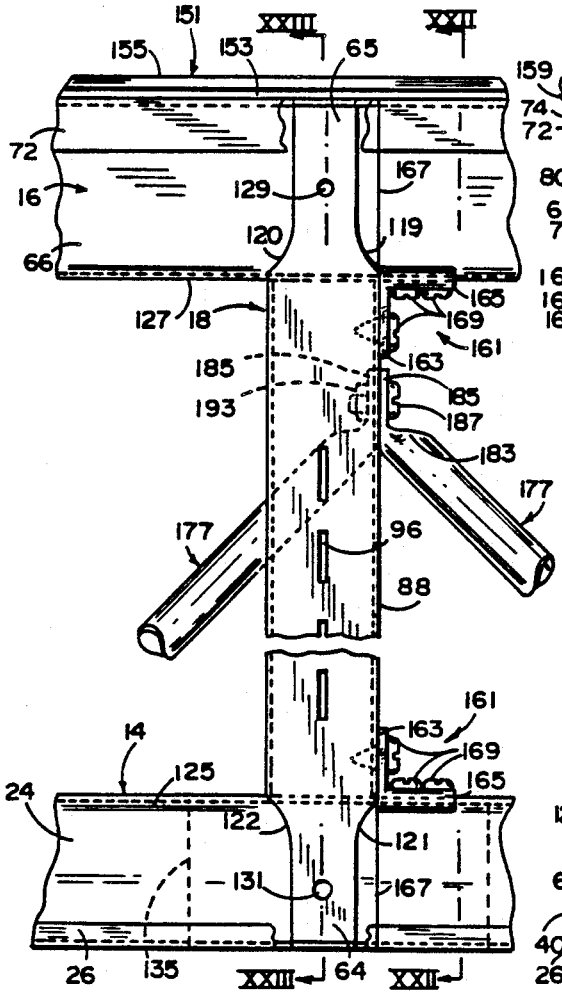
FIG. 21
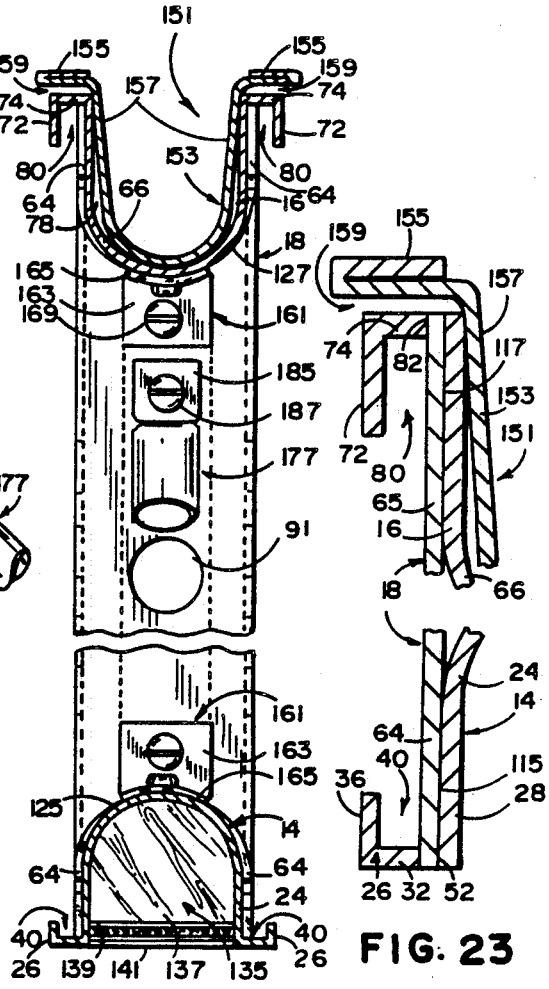
FIG. 23
FIG. 22

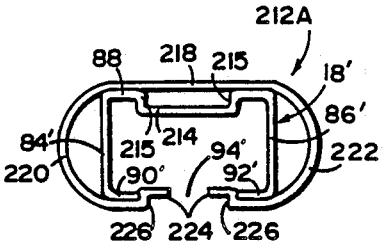
FIG. 25A
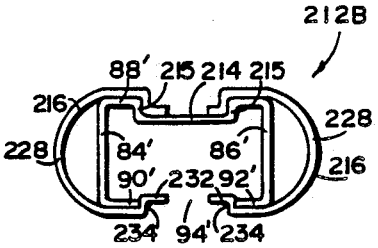
FIG. 25B
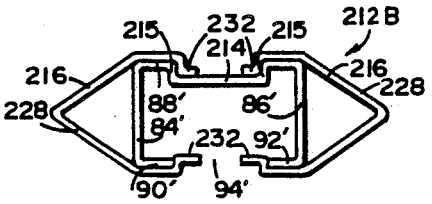
FIG. 25C
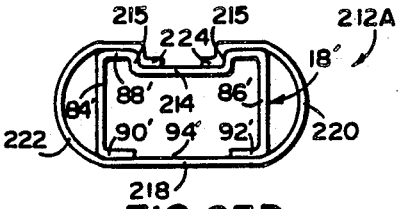
FIG. 25D
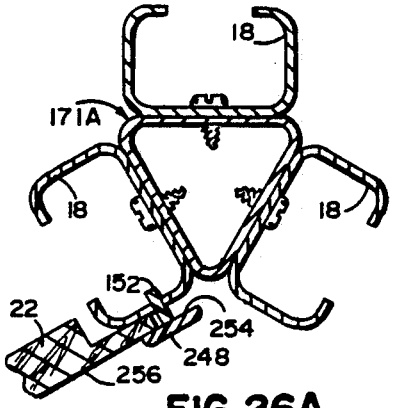
FIG. 26A
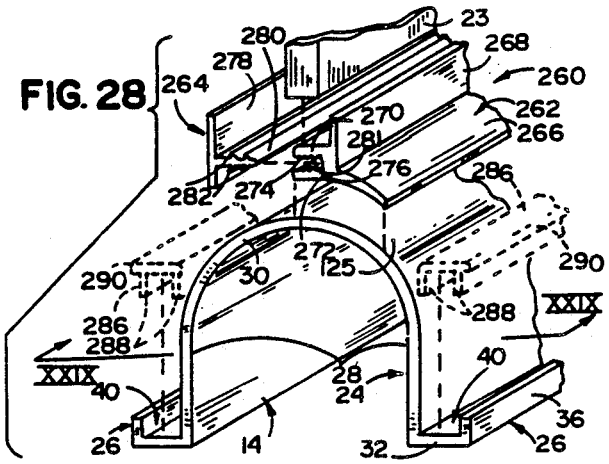
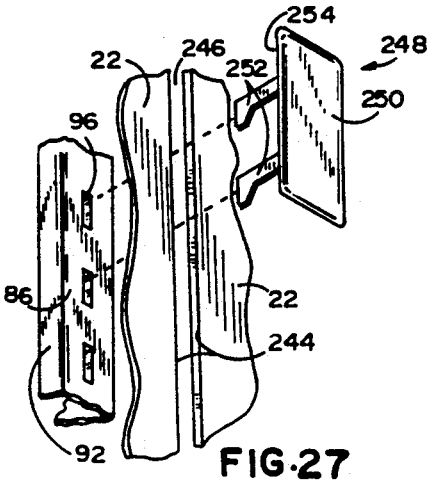
FIG. 27
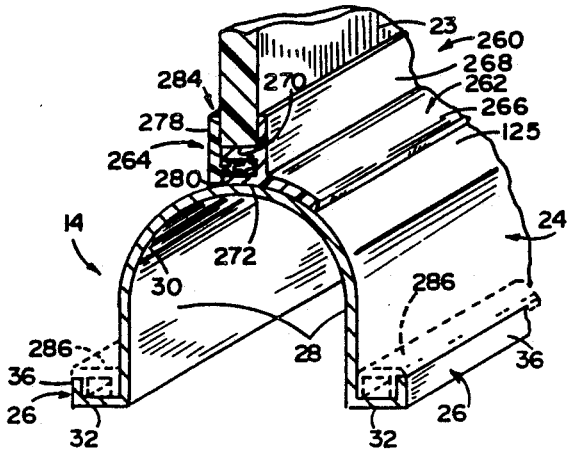
FIG. 29

WALL SYSTEM

BACKGROUND OF THE INVENTION

The present invention pertains to wall systems, and in particular, to a wall system specially suited for partitioning the floor space of retail establishments into various display areas.

In retail establishments, the available floor space is often partitioned to separate differing goods and permit various displays to be attractively set up independently of one another. However, wall partitions heretofore have been unwieldy, complicated, expensive and/or lacking in versatility. Furthermore, partitions spanning any significant length of the floor have either needed to be anchored to a perimeter wall or ceiling along their top edges, or have required laterally projecting legs every few feet for stability.

As can be readily appreciated, these options have serious drawbacks. The necessity of anchoring the partitions to a perimeter wall or ceiling of the building, substantially limits the placing of the partitions and/or the type of displays which may be assembled. While use of laterally projecting legs increases the versatility of the wall systems, the legs themselves create annoying obstructions which must be worked around in setting up the displays, detract from the appearance of the displays, and at times cause hazards for shoppers and employees.

SUMMARY OF THE INVENTION

The aforementioned problems and deficiencies are overcome in the present invention, wherein a unique wall system having a novel construction is provided which offers great versatility to the user.

The wall system of the present invention includes a structural framework which is easy to assemble, inexpensive to fabricate and has sufficient rigidity to permit large spans, of up to twenty feet between anchoring means, to be erected without intermediate top anchoring arrangements or laterally projecting legs. Moreover, the structure permits a wide diversity of display arrangements to be utilized, and thus provides an enormous amount of versatility.

As another aspect of the present invention, the wall system further includes a bottom anchoring arrangement which utilizes hook and loop type fastening sheets (i.e. VELCRO sheets) and adhesive. Such a construction not only facilitates easy erection of the wall system, but also permits easy removal of the wall from a location without entailing substantial repair of the floor anchoring locations.

These and other objections, advantages and features of the invention will be more readily understood and appreciated by reference to the detailed description of the preferred embodiment and the drawings.

BRIEF DESCRIPTION OF THE DRAWINGS

FIG. 18 is a front elevational view of a top stabilizing rail of the wall system;

FIG. 19 is a cross-sectional view taken along line XIX—XIX in FIG. 18;

FIG. 21 is a fragmentary front elevational view of two walls joined together;

FIG. 22 is a cross-sectional view taken along line XXII—XXII in FIG. 21;

FIG. 23 is a fragmentary cross-sectional view taken along lines XXIII—XXIII in FIG. 21;

FIGS. 25A-25D are end views of alternative vertical struts provided with various decorative covers;

FIG. 26A is an alternative coupling post joining three non-aligned walls;

FIG. 27 is a fragmentary, exploded perspective view of a clip securing two adjacent display panels;

FIG. 28 is a fragmentary, exploded perspective view of the bottom rail and a septum display panel; and FIG. 29 is a cross-sectional view taken along line XXIX—XXIX in FIG. 28.

DETAILED DESCRIPTION OF THE PREFERRED EMBODIMENT

Figure 20:
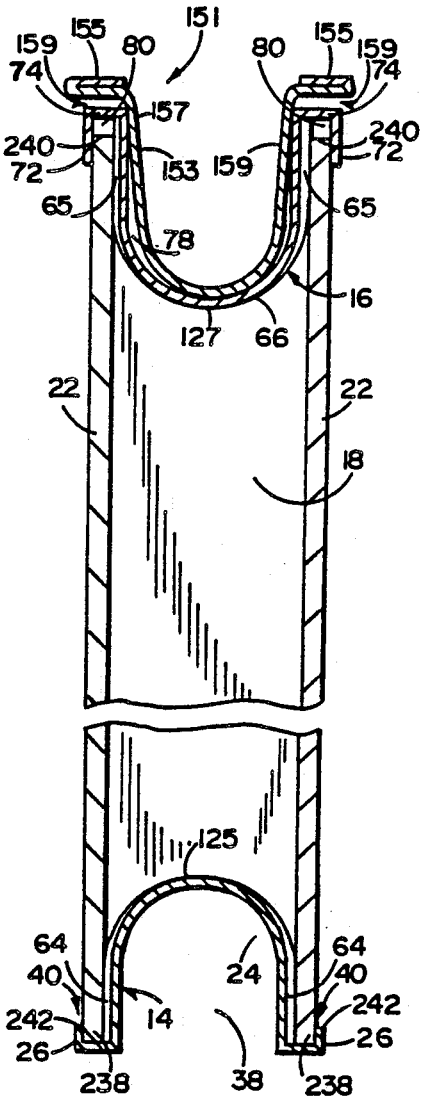
FIG. 20 is a cross-sectional view taken along line XX—XX in FIG. 3 with the addition of two display panels.

The wall system 10 of the present invention includes an open framework 12 comprised of a bottom rail 14, a top rail 16 and a plurality of vertical struts 18 interconnecting the two rails 14, 16. The erected wall 20 has sufficient rigidity to span up to twenty feet of floor space. Further, the wall 20 can be assembled as an open structure (FIG. 1) or a closed structure utilizing display panels 22, 23 (FIGS. 20 and 29).

Bottom rail 14 is preferably an elongated metal member composed of steel or aluminum (FIGS. 4–7). Of course other materials having the requisite strength could be used. Bottom rail 14 is typically machine formed from a blank sheet; although other methods of manufacture, such as extrusion, could be used. Bottom rail 14 is configured to have a central body portion 24 and a pair of opposite side flanges 26. Body portion 24 has an inverted U-shape defined by a pair of legs 28 and an interconnecting, rounded bight segment 30. Side flanges 26 are L-shaped and each include a base leg 32 adapted to lie along the floor 34, and an upstanding leg 36 oriented substantially parallel to legs 28. Bottom rail 14, then, defines a large inner channel 38 within body portion 24 and a pair of shallow outer channels 40 between each leg 28 and one upstanding leg 36.

Figure 11:
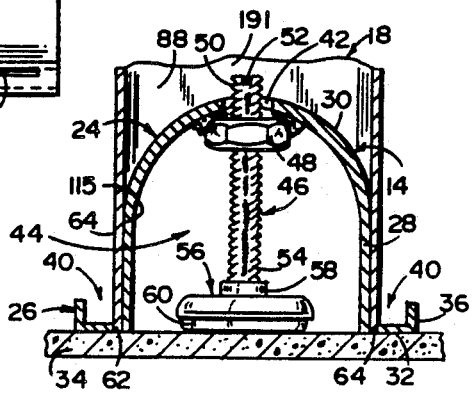
FIG. 11 is a cross-sectional view taken along line XI—XI in FIG. 1.
Figure 14:
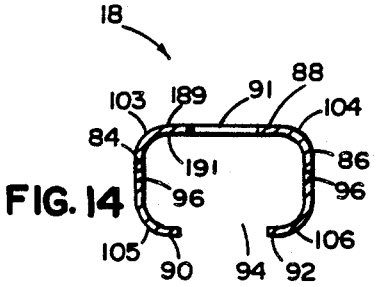
FIG. 14 is a cross-sectional view taken along line XIV—XIV in FIG. 13.

A series of spaced apart holes 42 are defined along the ridge of bight segment 30. Holes 42 are provided to permit access to and provide adequate head space for leveling devices 44 positioned within inner channel 38 (FIG. 11). Each leveling device 44 includes a threaded rod 46 received through a weld nut 48 for vertical adjustment thereof. Rod 46 includes an upper end 50 defining a slot 52 for receiving a conventional screw driver (not shown), and a lower end 54 rotatably attached to a foot 56. Foot 56 preferably defines a socket 58 for receiving and retaining rod 46, and a pad 60 for engaging the floor 34. Leveling devices 44 are manually operated in the erection of the wall 20, until bottom rail 14 assumes a substantially true horizontal position.

A row of slots 62 are defined in each base leg 32 in general alignment with holes 42 (FIGS. 4–7). Slots 62 are elongated, narrow openings positioned directly adjacent legs 28 of body portion 24. Slots 62 are provided to receive projections 64 extending from struts 18, as will be discussed below.

Top rail 16 is an elongated member positioned in a substantially parallel relation to bottom rail 14. Top rail 16 is preferably composed of steel or aluminum, but could be composed of other materials having the requisite strength and rigidity. As with bottom rail 14, top rail 16 is preferably machine formed from blank stock, but could be formed by other techniques, such as extrusion.

Top rail 16 has a similar shape to bottom rail 14, although with an inverted orientation. More specifically, top rail 16 includes a U-shaped body portion 66 defined by a pair of legs 68 and a rounded bight segment 70, and a pair of L-shaped side flanges 72 each having a base leg 74 and vertical leg 76. Defined inner and outer channels 78, 80 of top rail 16 each have a greater depth than their counterpart on bottom rail 14. A series of spaced apart slots 82 are provided in base leg 74 adjacent legs 68 of body portion 66. Each slot 82 in the rail 16 is aligned with a corresponding slot 62 defined in bottom rail 14. Top slots 82 cooperate with bottom slots 62 to receive strut projections 64, 65 and thereby retain each strut 18 in place.

Struts 18 are vertically positioned between the two rails 14, 16 and have lengths sized to the desired height of the wall 20 (FIGS. 1, 3–4 and 12–14). Generally, struts 18 are spaced at two foot centers, though other spacing arrangements could be used. Struts 18 are preferably composed of steel or aluminum, although other materials having the requisite strength could be used. Struts 18 are also preferably fabricated by machine forming of blank stock but other techniques, such as extrusion may be used.

Each strut 18 is an elongated member having a generally rounded C-shaped cross-sectional configuration. This shape is defined by identical front and rear walls 84, 86, a sidewall 88 extending between walls 84, 86, and a pair of inturned side segments 90, 92 projecting inwardly from walls 84, 86, respectively. Sidewall 88 generally includes openings 91 for receiving electrical conduit 93 or the like therethrough. Side segments 90, 92 are substantially aligned with one another and define therebetween a gap 94. Gap 94 may be covered by a removable cover 95 if desired. Cover 95 can be snap fit in place, or secured by any known means.

Figure 1:
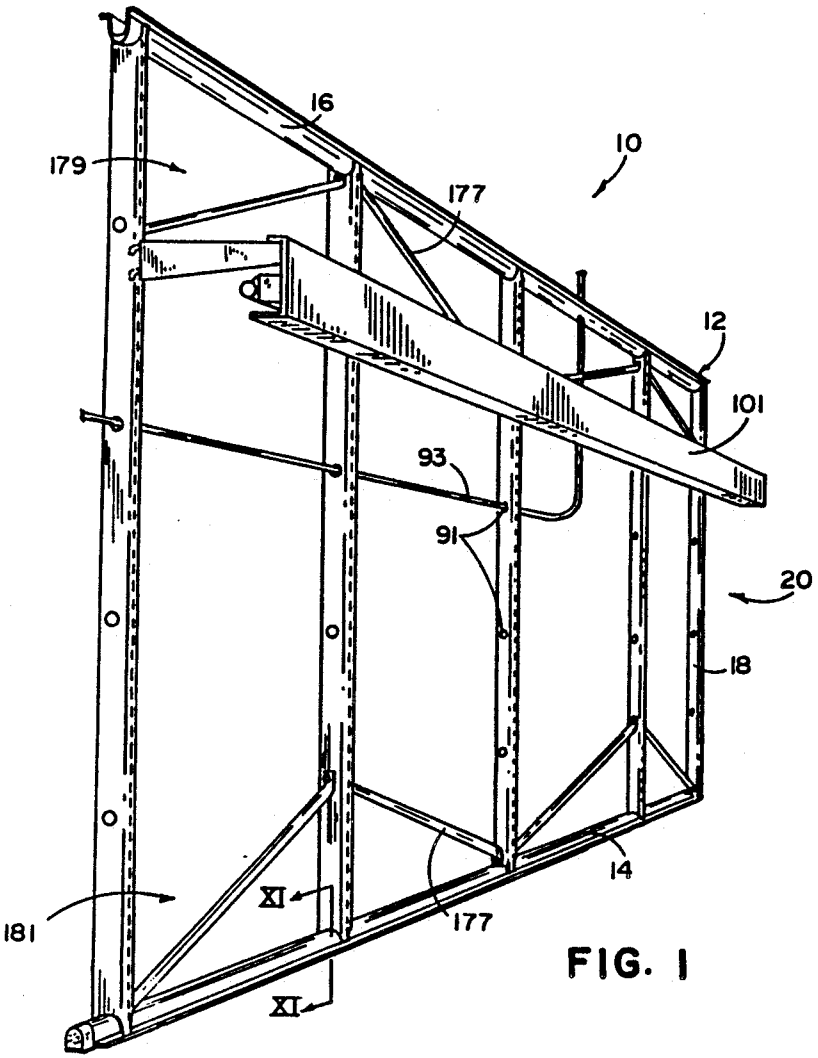
FIG. 1 is a perspective view of an open wall structure of the present invention.

Front and rear walls 84, 86 each define a plurality of vertically aligned openings 96 along a central portion 98, 99 thereof. Openings 96 have narrow rectangular shapes and are adapted to receive conventional bracket hooks in the mounting of various items, such as shelves, lighting fixtures, etc. In FIG. 1, a cornice 101 is shown mounted in such a manner. The row of openings 96 extend along substantially the entire length of each strut 18 to accommodate the mounting of items at a wide range of elevations.

Central portions 98, 99 of walls 84, 86 are substantially planar in shape, as are sidewall 88 and side segments 90, 92. These planar portions are connected by smooth, continuous rounded corners 103–106. At the upper and lower ends 111, 113 of each strut 18, central portions 98, 99 extend longitudinally beyond corners 103–106, sidewall 88 and side segments 90, 92, to define upper and lower projections 65, 64.

When wall 20 is assembled, projections 64, 65 are received within slots 62, 8 of rails 14, 16 to retain the strut 18 in its proper position (FIGS. 4, 11, 15 and 23). Inner surfaces 115, 117 of projections 64, 65 then lie contiguously along legs 28, 68 of rails 14, 16, respectively. This arrangement, in turn, places sidewall 88, side segments 90, 92 and corners 103–106 between opposed body portions 24, 66. The upper and lower edges 119–122 of these intermediate portions are rounded to conform and engage convex faces 125, 127 of body portions 24, 66. Upper edges 119, 120 are substantially the same as lower edges 121, 122, respectively, except that upper edges 119, 120 have a deeper arcuate shape to correspond to the larger size of the upper body portion 66 as compared to lower body portion 24. This engaged arrangement provides a sturdy and attractive appearance.

Figure 4:
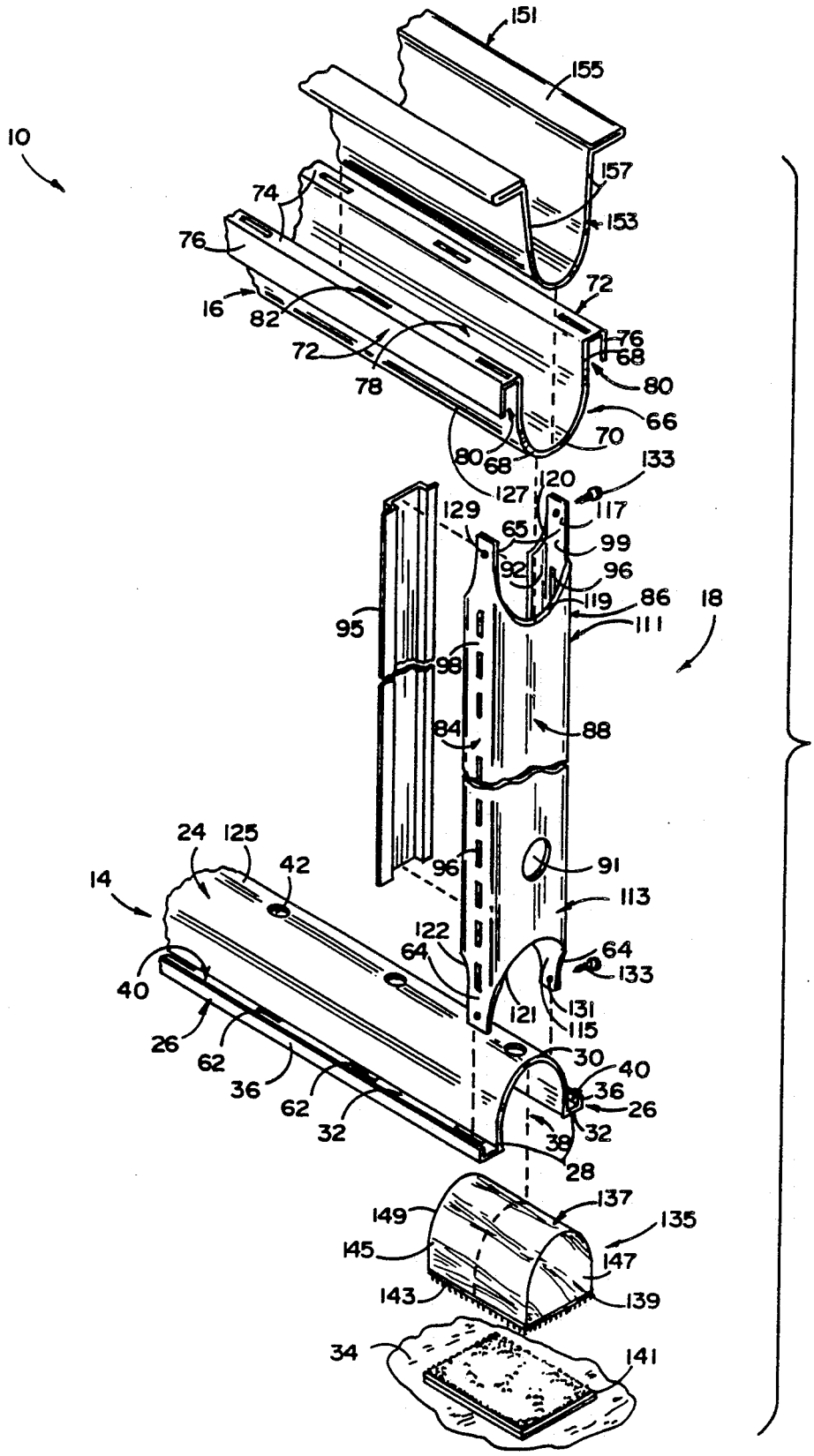
FIG. 4 is an exploded, fragmentary, perspective view of the wall structure.
Figure 5:
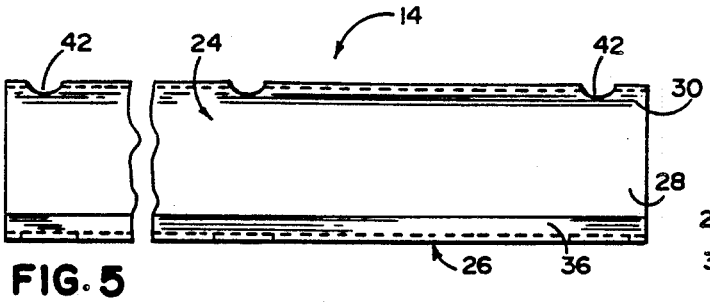
FIG. 5 is a front elevational view of a bottom rail of the wall system.
Figure 7:
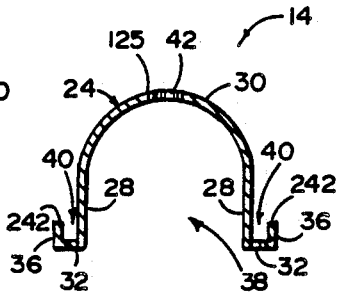
FIG. 7 is a cross-sectional view taken along line VII—VII in FIG. 6.
Figure 6:
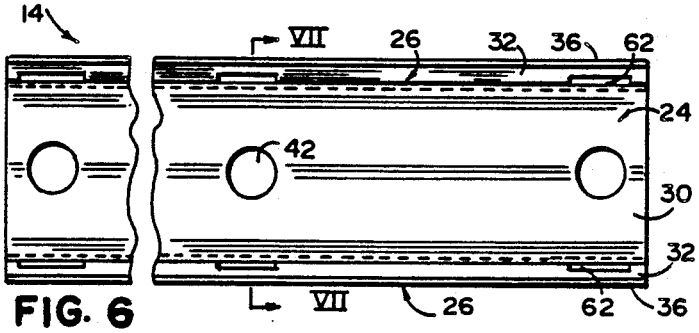
FIG. 6 is a top plan view of the bottom rail.
Figure 8:
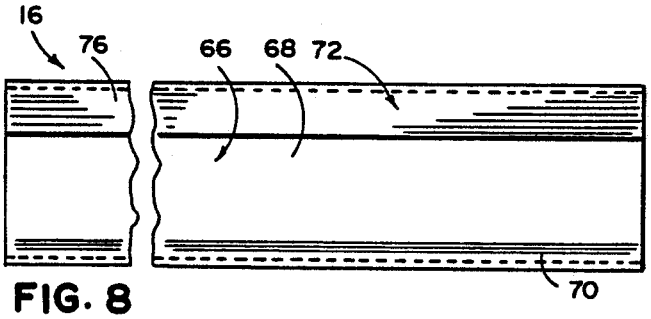
FIG. 8 is a front elevational view of a top rail of the wall system.
Figure 10:
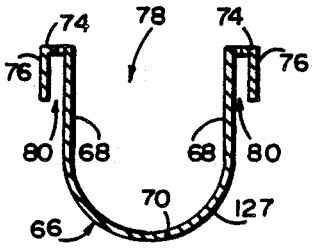
FIG. 10 is a cross-sectional view taken along line X—X in FIG. 9.
Figure 9:
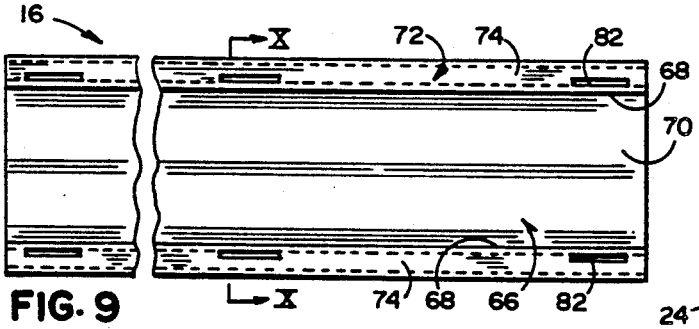
FIG. 9 is a top plan view of the top rail.

Top and bottom mounting holes 129, 131 are provided in projections 65, 64, respectively, in order to couple struts 18 securely to rails 16, 14 (FIG. 4). More specifically, screws 133 (preferably sheet metal screws) are passed through holes 131, 129 and threaded into legs 28, 68 of rails 14, 16, respectively. Only one screw 133 in each end 111, 113 of strut 18 need be used to erect a stable wall 20. Of course, a screw 133 in each mounting hole 129, 131 may be used if desired.

Figure 16:
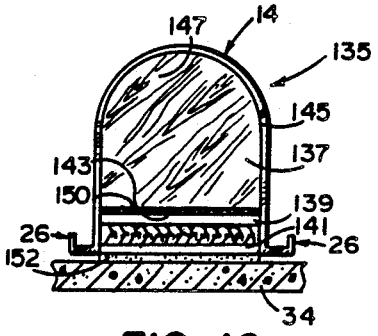
FIG. 16 is a partially exploded end view of the bottom rail including an anchoring device.
Figure 17:
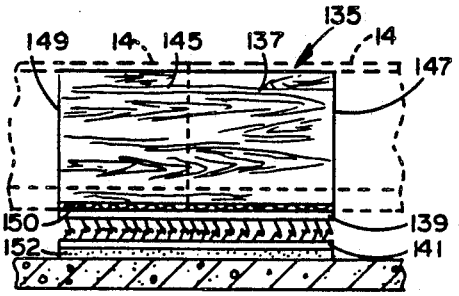
FIG. 17 is a partially exploded front elevational view of the anchoring device with the bottom rail shown in phantom.
Figure 15:
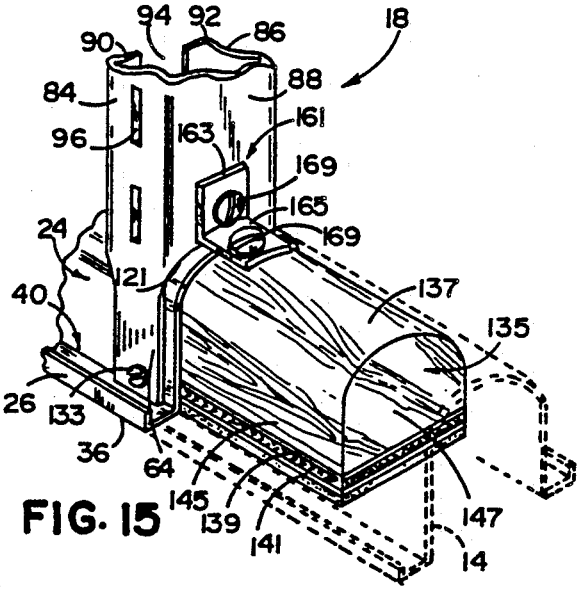
FIG. 15 is a fragmentary perspective view of a pair of joined bottom rails of two aligned walls with the bottom rail of one wall shown in phantom.

The bottom of the walls 20 are secured against lateral sliding movement along the floor 34 by anchoring devices 135 (FIGS. 15–17). Under normal circumstances, anchoring devices 135 are positioned at the ends of each particular wall 20—which will typically be at ten feet intervals. Of course, anchoring devices could be positioned at any shorter interval if desired.

Each anchoring device 135 is comprised of a block 137 and two interlocking sheets of hook and loop type fasteners 139, 141 (e.g. VELCRO fasteners). More specifically, block 137 is preferably composed of wood, but could be composed of other materials having the required characteristics. Block 137 includes a base surface 143, an arcuate surface 145 and two end surfaces 147, 149. Arcuate surface 145 is sized and shaped to generally conform to the shape and size of inner channel 38 of bottom rail 14, so that block 137 is adapted to be received therein. When block 137 is positioned at the end of a wall 20 not to be joined to an aligned wall, it is received wholly within the bottom rail 14. HoWeVer, when it is placed at the interconnection of two adjacent, aligned walls 20, 20' (as discussed below), block 137 is positioned to extend into both bottom rails (FIGS. 15 and 17).

Sheets 139, 141 are secured to base surface 143 and floor 34, respectively, through the use of conventional adhesives 150, 152 (as illustrated in an exaggerated manner in FIGS. 16 and 17). The use of hook and loop fastener sheets 139, 141 and adhesives 150, 152 permits the bottom rails to be securely anchored against sliding, without marring or destroying the floor surface. In the event, that walls 20 are to be rearranged, the anchoring devices 135 can be removed without requiring the floor 34 to be repaired, as is the case when bolts are used.

A top stabilizing rail 151 is provided to rigidify wall 20 and preclude lateral sagging in the top rail 16 (FIGS. 4, 18–20 and 22). Stabilizing rail 151 is generally only used to strengthen an unanchored rail 16. If top rail 16 extends along a perimeter wall or ceiling, it may be securely anchored thereto by well-known brackets and/or bolts. Stabilizing rail 151 is preferably composed of steel or aluminum and is fabricated by a machine forming process. Other materials, though, having the requisite strength and rigidity could be used.

Stabilizing rail 151 includes an elongated generally U-shaped trough 153 and a pair of seamed flanges 155 extending along each side thereof. Each seamed flange 155 is comprised of two thicknesses of the sheet folded back upon one another. This construction greatly increases the stabilizing rail's resistance to lateral bending. The sides 157 of trough 153 are diverging slightly to ensure a secure engagement is made along the upper ends of legs 68 of top rail 16.

In use, stabilizing rail 151 is received within inner channel 78 of top rail 16. A gap 159 is defined between seamed flanges 155 and base legs 74 (FIGS. 20, 22 and 23), to provide space for derivations in the lengths of the struts 18, and to provide some vertical freedom of movement for stabilizing rail 151 to account for derivations in the width of inner channels 78.

Top and bottom rails 16, 14 preferably are formed with ten foot lengths to define walls 20 with spans of ten feet. At times in the assembly of display areas, walls having greater lengths than ten feet are desired. In such situations, two aligned walls 20 are placed in end-to-end abutment with each other. Two generally L-shaped joining brackets 161 are provided to join the walls together (FIGS. 3, 15, 21 and 22). Furthermore, if provided, stabilizing rail 151 is sized and positioned so that it does not end at the seam 167 between two joined walls 20, to provide additional reinforcement.

Joining brackets 161 are preferably formed of steel, although other materials having sufficient strength could be used. Each joining bracket 161 includes a strut plate 163 and a rail plate 165. Strut plates 163 have substantially planar configurations and abuttingly engage the outer faces 147 of strut sidewalls 88. Rail plates 165 have arcuate shapes which conform and engage along the ridges of convex faces 125, 127 of rails 14, 16, respectively.

In use, joining brackets 161 are placed over the seams 167 formed by the abutting walls 20 (FIGS. 3, 15, 21 and 22). More specifically, one joining bracket 161 is placed against the lower end 113 of strut 18 and bottom rail 14. Another joining bracket 161 is placed against the upper end 111 of strut 18 and top rail 16. Both plates 163, 165 of each joining bracket define apertures through which joining screws 169 (preferably sheet metal screws) are passed. In the most preferred embodiment, one joining screw is passed through strut plate 163 and two through rail plate 165. Of course this screw arrangement could be modified. In any event, joining brackets 161 in cooperation with joining screws 169 securely, but releasably, join the walls together.

Figure 26:
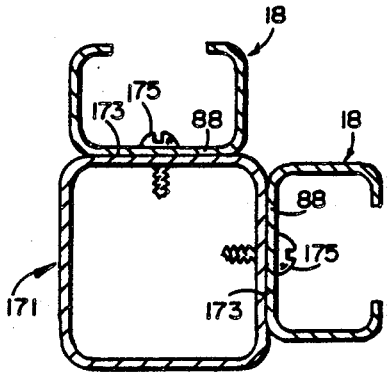
FIG. 26 is a cross-sectional view taken along lines XXVI—XXVI in FIG. 3.
Figure 12:
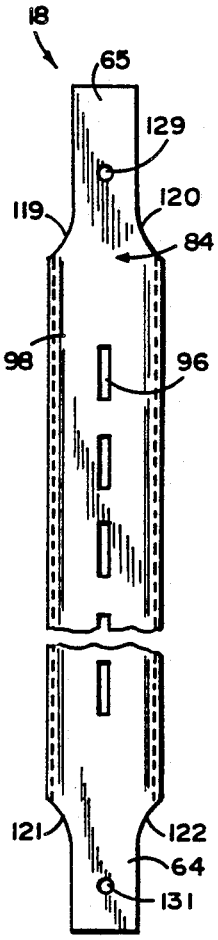
FIG. 12 is a front elevational view of a vertical strut of the wall system.
Figure 13:
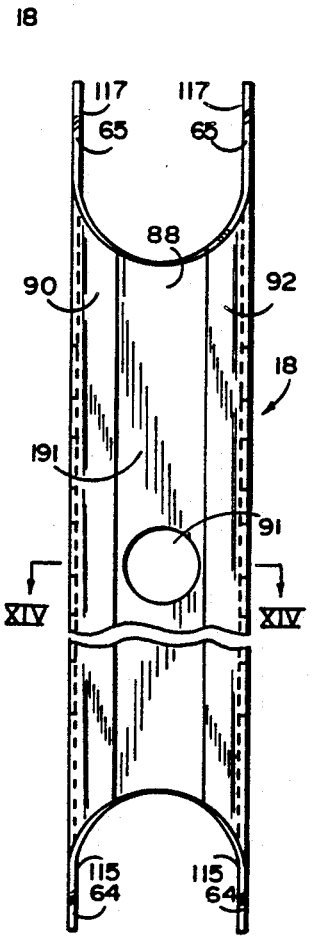
FIG. 13 is a side elevational view of the vertical strut.

Also, at times, walls 20 are joined together at angles to one another. In these situations, a coupling post 171 is used (FIGS. 2, 3, 26 and 26A). Coupling post 171 is preferably composed of steel or aluminum (although other materials with the required strength could be used); and has a tubular construction. The cross-sectional shape of the post 171 will vary depending upon the angle at which the non-aligned walls 20 are to be joined. For example, as seen in FIG. 26, coupling post 171 is substantially square (or rectangular) so that coupling faces 173 are placed at right angles to one another. Alternatively, as illustrated in FIG. 26A, the coupling post 171A could have a triangular shape to form the hub for three intersecting walls. Coupling posts 171, then, can have many diverse shapes to meet the needs of the display to be erected.

Figure 2:
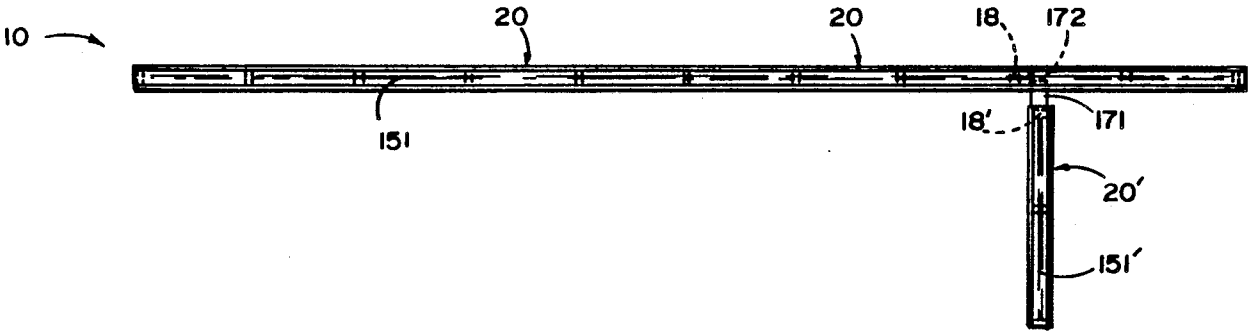
FIG. 2 is a top plan view of the wall system including two perpendicular walls joined together.
Figure 3:
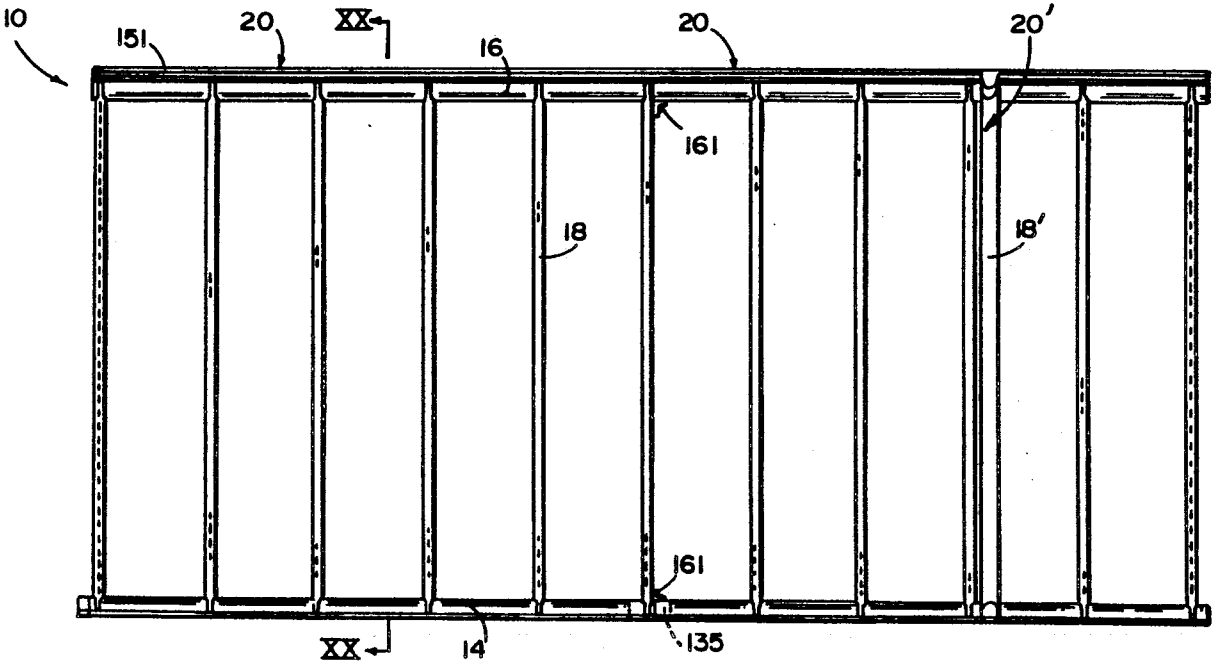
FIG. 3 is a front elevational view of the wall system illustrated in FIG. 2.

In certain situations, such as illustrated in FIGS. 2 and 3, connectors 172 may be used to connect struts 18 to post 171. For example, in the embodiment of FIGS. 2 and 3, coupling post 171 is positioned along side of wall 20 and adjacent the end of wall 20'. In this arrangement, post 171 is directly attached to the end strut 18' of wall 20' (in a manner as shown in FIG. 26). However, a connector 172, having for example an L-shape, is used to connect sidewall 88 of strut 18 in wall 20 to coupling face 173 of post 171. In any event, irrespective of whether connectors 172 are used, coupling posts 171 are merely used as connectors and do not generally engage the floor or other supporting structures.

To join non-aligned adjacent walls 20 together at a hub, a coupling post 171 is placed flush against a strut 18 of each wall span to be joined (FIGS. 26 and 26A); such that the appropriate coupling faces 173 engage the strut sidewalls 88 along their lengths. These abutting surfaces are then securely attached by a series of vertically spaced coupling screws 175 (preferably sheet metal screws). Struts 18 and coupling posts 171 will typically be drilled at the site during erection of the walls for the passage of screws 175. Nevertheless, holes may be preformed for prefabrication units.

Figure 24:
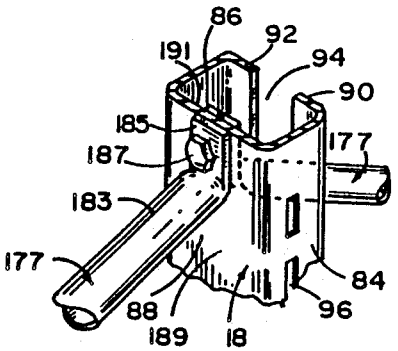
FIG. 24 is a fragmentary perspective view of two diagonal supporting bars connected to a vertical strut.

When wall 20 is to be assembled as an open frame structure, diagonal support bars 177 are provided between adjacent struts 18 (FIGS. 1, 21 and 24). Bars 177 are arranged into upper and lower sets of supports 179, 181 which span the entire length of wall 20. Each set of supports 179, 181 collectively define an serpentine or serrated path. In the most preferred embodiment, the two bars 177 between each pair of struts 18 are parallel with each other to provide a more rigid framework 12.

Each support bar 177 is preferably formed as a tubular member composed of steel or aluminum, although other materials having the requisite strength and rigidity could be used. Each end 183 thereof is flattened and bent to define a tab 185. Tabs 185 are preferably bent at a 45° angle to the longitudinal axis of bar 177, to mount bar 177 at a 45° slope. Of course these angeles could be modified.

To mount bars 177 to struts 18, tabs 185 are provided with bores (not shown) which are adapted to receive therethrough coupling bolts 187. More particularly, each rod 177 is positioned such that one tab 185 engages the outer face 189 of sidewall 88 of one strut 18 and the opposite tab 185 engages the inner face 191 of sidewall 88 of an adjacent strut 18. Gaps 94 are therefore shaped slightly larger than the diameters of bars 177, so that the bars 177 can be easily received therethrough for mounting. Once two tabs 185 are engaged opposite to each other on a sidewall 88, a coupling bolt 187 may be inserted and secured with a corresponding nut 193.

Additionally in an open frame structure, removable decorative covers 212 may be provided over vertical struts 18, 18' (FIGS. 25A–D). Preferably, covers 212 are utilized in conjunction with alternative vertical struts 18' but could in some cases be attached to struts 18. Alternative struts 18' are identical in function, and similar in shape, to vertical struts 18 discussed above. More particularly, each strut 18' includes front and rear walls 84', 86', a sidewall 88', and a pair of side segments 90', 92' which are planar in shape and interconnected by squared corners 103'–106'. Furthermore, sidewall 88' includes an offset portion 214 defining shoulders 215 which are provided to mount several types of covers 212. The ends (not shown) of struts 18' are fashioned and interconnected to rails 14, 16 in the same manner as discussed above for struts 18.

Covers 212 are preferably fabricated as elongated resilient plastic extrusions of various shapes, sizes and colors (FIGS. 25A–D). Covers 212 may also be fabricated as a single unitary piece or as a pair of cover pieces 216. The unitary covers 212A are primarily intended for use on walls 20 that may be anchored along their upper edge to a perimeter wall or ceiling, and thereby do not require diagonal support bars 177. However, these may be accommodated if the covers 212A are cut to appropriate lengths and positioned to provide access for the mounting of the bars 177 to struts 18, 18'. Moreover, unitary covers 212A, if mounted in the manner as shown in FIG. 25A, may be installed on primary vertical struts 18. The separable covers 212B comprised of cover pieces 216 may easily be used with support bars 177, since the sidewall 88 is not entirely covered with the cover pieces 216. Furthermore, covers of different shapes, sizes and/or colors may be mixed and matched on different sides of struts 18' (or used on only one side) to meet the specific needs of the different displays in the retail establishments.

Unitary covers 212A each include a side member 218, front and rear members 220, 222, and a pair of locking segments 224. Side members 218 are generally planar in shape and are adapted to engage and cover either the sidewalls 88' (FIG. 25A) or side segments 90', 92' (FIG. 25D) of struts 18'. Front and rear members 220, 222 are the portions to be primarily visible to the public. Accordingly, front and rear members 220, 222 may have a variety of shapes, sizes and colors. Locking segments 224 each have an L-shaped free end 226 adapted to interlock with either shoulders 215 of sidewall 88' (FIG. 25D) or side segments 90', 92' (FIG. 25A). In attaching a unitary cover 212A, one locking segment 224 is generally hooked on one shoulder 215 or side segment 90' or 92' and resiliently deformed and stretch to snap-fit lock on the strut 18'.

Separable cover pieces 212B include front members 228 of any shape, size or color which are bordered on each end by a locking segment 232. Locking segments 232 are L-shaped at their free ends 234 and are adapted to engage the offset section 214 of sidewall 88' and side segments 90', 92'. In a manner similar to unitary covers 212A, covers 212B are attached to struts 18' by hooking one locking segment 232 on either one shoulder 215 or side segment 90' or 92' and resiliently deforming and stretching the cover to snap-fit lock it on the front or rear of the strut 18'.

When wall 20 is to be assembled as a closed frame structure, a plurality of display panels 22 may be installed between rails 14, 16. Display panels 22 are preferably solid rectangular members composed of plastic (or other suitable material) and having any color or surface texture. Furthermore, display panels 22 may be transparent, translucent or mirrored; or even irregular non-solid structures, such as perforated sheets or a rigid grid of vertical and horizontal members. Panels fabricated of a rigid framework covered by a fabric may also be used. In any event, display panels 22 are to be installed between each strut 18 and extend the entire height between rails 14, 16.

Display panels 22 are held along their lower and upper edges 238, 240 by outer channels 40, 80, respectively. Display panels 236 are installed by inserting upper edge 240 into top outer channel 80 until the edge 240 engages top base leg 74. In this position, lower edge 238 will clear the free end 242 of upstanding leg 36 so that the panel 22 may be swung toward rail 14 and be aligned with lower outer channel 40. At this point, display panel 22 is lowered and set upon lower base leg 32. As seen in FIG. 20, vertical leg 36 is sufficiently long to still retain the upper edge 240 of display panel 22 when set down in channel 40. These panels 22 may be installed in either or both sets of outer channels 40, 80, depending upon the specific needs, of the displays to be assembled.

The side edges 244 of display panels 22, when installed, overlie a portion of front or rear wall 84, 86 of strut 18. More specifically, side edges 244 lie adjacent to the row of openings 96 such that a gap 246, aligned with openings 96, is defined when two display panels 22, 22' are mounted adjacent one another. Clips 248 having a planar body 250 and a pair of hooks 252 are used to retain side edges 244 of panels 22 against struts 18. Hooks 252 are adapted to be received through and retained in a pair of openings 96 in a conventional manner, and are sized such that the rear face 254 of body 250 snugly engages the outer surface 256 of each display panel 22. Gap 246 additionally permits the installation of shelves, lighting fixtures, etc.

Walls 20 may also be fitted with septum panels 23 to form a closed frame structure. Septum panels 23 are secured in place by septum frames 260 which are secured along the convex surfaces 125, 127 of rails 14, 16. Septum panels 23 are identical to display panels 22 in variety and form. However, septum panels 23 are shorter in height since they are mounted between the ridges of the body portions 24, 66 and not in outer channels 40, 80.

Each septum frame 260 is comprised of a main member 262 and an attachment 264. Preferably, the septum frame components 262, 264 are composed of a plastic material, put could of course be composed of a variety of materials having the requisite characteristics. Furthermore, septum frame components 262, 264 are preferably fabricated by extrusion techniques, although other manufacturing processes could be used.

Main member 262 of each septum frame 260 includes an arcuate base 266 which is curved to correspond and engage the convex surface 125, 127 of one of the rails 14, 16. Arcuate bases 266, are attached to rails 14, 16 through the use of screws (not shown) or other known means. Projecting upwardly from the mid-section of each arcuate base 266 is a generally T-shaped portion having a vertical retaining wall 268 and a horizontally extending segment 270. Horizontal segment 270 is spaced slightly from and overlies the ridge portion 272 of base 266. The opposing faces 274, 276 of horizontal segment 270 and ridge portion 272 are preferably serrated 281 to securely mount attachment 264, as described below.

Attachment 264 of each septum frame 260 is fabricated as a T-shape member having a vertical retaining wall 278 and a horizontal prong 280. Prong 280 is provided with a plurality of elongated, tapered barbs 282 along its length. Prong 280 is sized and adapted to be matingly received between opposing faces 274, 276 of main member 262. When prong 280 is so inserted barbs 282 interlock with serrations 281 to securely hold attachment 264 in place. Nevertheless, barbs 282 are flexible so that attachment 264 may be manually pried from main member 262. This permits the septum panels 23 to be easily removed and replaced. Vertical retaining wall 278 is substantially parallel to vertical retaining wall 268, and cooperatively forms a septum channel 284 with wall 268 and segment 270. Septum channels 284 are adapted to receive and hold septum panels 23 in place.

Moreover, since struts 18 are not directly involved with the securing of septum panels 23, covers 212 may be used in conjunction with such septum panels. Additionally, channel inserts 286 may be installed in outer channels 40, 80 to thereby reduce their visual impact to the public. Channel inserts 286 are preferably extruded plastic members of various shapes, sizes and colors. For example, as shown in FIGS. 28 and 29, inserts 286 may be provided with two downwardly extending holding legs 288 and a top cover member 290. Further, as with covers 212B, inserts 286 may be mixed and matched in any desired manner.

The above description is that of preferred embodiments of the invention. Various alterations and changes can be made without departing from the spirit and broader aspects of the invention as set forth in the appended claims, which are to be interpreted in accordance with the principle of patent law, including the Doctrine of Equivalents.

The embodiments of the invention in which an exclusive property or privilege is claimed are defined as follows:

1. A wall system comprising:

a top rail and a bottom rail, each said rail including a central portion and a pair of side channels, said side channels of each rail having an orientation which opens toward and is aligned with a corresponding channel on the other rail, each said channel further including a row of slots positioned adjacent said central portion, each said slot being aligned laterally with another slot in the other channel of the same rail and aligned vertically with the slot in the corresponding channel of the other rail;

a plurality of vertical, spaced apart struts interconnecting said top and bottom rails, each said strut having a plurality of projections which are received within said slots in said rails; and fastening means for positively attaching said struts to said rails.

2. A wall system as defined in claim 1 in which said central portion of each said rail has a substantially U-shaped configuration which includes a pair of legs and an interconnecting rounded bight segment, wherein said bight segments each define an outer convex surface, and wherein said convex surfaces are in an opposed relation with each other; and in which said struts include a pair of ends which each define arcuate edges adapted to engage and conform to the central portion of the engaged rail, such that said struts straddle said central portions of said rails.

3. A wall system as defined in claim 2 which further includes at least one anchoring device, wherein said anchoring device includes: a block received within said U-shaped central portion of said bottom rail; and securing means for releasably attaching said block to the floor.

4. A wall system as defined in claim 3 in which said securing means includes two sheets of interlocking hook and loop fasteners, wherein one sheet is attached to said block and the other sheet is attached to the floor.

5. A wall system as defined in claim 4 in which an adhesive layer is provided to attach each said sheet of hook and loop fasteners to the corresponding block and floor.

6. A wall system as defined in claim 2 which further includes a stabilizing rail having a center section and a pair of side members, wherein said center section is shaped to be received in said U-shaped central portion of said top rail and engage said legs thereof, to thereby reinforce said top rail and preclude lateral sagging thereof.

7. A wall system as defined in claim 6 wherein each said side member of said stabilizing rail includes a pair of planar members seamed together upon one another to provide a greater capacity to resist lateral bending.

8. A wall system as defined in claim 6 wherein said center section includes a pair of diverging legs which are adapted to engage said legs of said top rail near their engagement with said side flanges.

9. A wall system as defined in claim 2 which further includes a plurality of leveling devices positioned within said U-shaped central portion of said bottom rail, wherein each said leveling device includes a threaded rod, means for engaging the floor, and a weld nut attached to said bottom rail and threadably receiving said threaded rod therethrough for adjustment thereof, and in which said central portion of said bottom rail defines a series of openings through which said threaded rod can be extended or accessed during a leveling operation.

10. A wall system as defined in claim 9 in which each said opening in said bottom rail is positioned to be substantially aligned with a longitudinal axis of one of said struts.

11. A wall system as defined in claim 1 which further includes at least one anchoring device, and in which said central portion of said bottom rail defines a channel between itself and the floor, wherein said anchoring device includes: a block received within said channel; and securing means for releasably attaching said block to the floor.

12. A wall system as defined in claim 11 in which said securing means includes two sheets of interlocking hook and loop fasteners, wherein one sheet is attached to said block and the other sheet is attached to the floor.

13. A wall system as defined in claim 12 in which an adhesive layer is provided to attach each sheet of hook and loop fasteners to the corresponding block and floor.

14. A wall system as defined in claim 1 which further includes a stabilizing rail having a central section and a pair of side members, and in which said central portion of said top rail is shaped to define a channel having opposite sides, wherein said center section is shaped to be received in said channel and engage said sides thereof, to thereby reinforce said top rail and preclude lateral sagging thereof.

15. A wall system as defined in claim 14 wherein each said side member of said stabilizing rail includes a pair of planar members seamed together upon one another to provide a greater capacity to resist lateral bending.

16. A wall system as defined in claim 1 which further includes a plurality of leveling devices, and in which said central portion of said bottom rail is shaped to define a channel between itself and the floor, wherein each said leveling device is positioned within said channel and includes a threaded rod, means for engaging the floor, and a weld nut attached to said bottom rail and threadedly receiving said threaded rod therethrough for adjustment thereof, and in which said central portion of said bottom rail further defines a series of openings through which said threaded rod can be extended or accessed during a leveling operation.

17. A wall system as defined in claim 16 in which each said opening in said bottom rail is positioned to be substantially aligned with a longitudinal axis of one of said struts.

18. A wall system as defined in claim 1 which further includes a plurality of display panels each of which are removably mounted between said rails, wherein each said display panel is received and releasably retained in one pair of aligned and opposed side channels of said rails.

19. A wall system as defined in claim 1 which further includes a plurality of display panels, wherein each display panel is mounted between the central portions of said rails and between each pair of vertical struts.

20. A wall system as defined in claim 19 in which said display panels are secured to each said rail by a frame, wherein said frame includes a main member attached to one of said rails and having a first retaining portion, and an attachment member releasably attached to said main member and having a second retaining portion which is spaced from and opposed to said first retaining portion when said attachment member is attached to said main member, such that said first and second retaining portions define a display channel into which one of said display panels is received and retained.

21. A wall system as defined in claim 20 in which said main member further includes a pair of attaching segments defining a gap and said attachment member further includes a prong adapted to be matingly received within said gap, wherein said prong includes means for releasably securing said prong within said gap.

22. A wall system as defined in claim 21 in which said retaining means of said prong includes a plurality of flexible barbs.

23. A wall system as defined in claim 1 which further includes a plurality of support bars, wherein said support bars define an upper set of supports near said top rail and a lower set of supports near said bottom rail, wherein each said support bar is attached to and secured between a pair of adjacent struts at an inclination thereto of a predetermined slope, and wherein said adjacent bars of the same set of supports have opposite slopes so that each set of supports has a serrated configuration.

24. A wall system as defined in claim 23 in which said bars of said different sets of supports positioned between the same two struts are positioned at the same slope.

25. A wall system as defined in claim 1 further including a plurality of non-aligned walls and at least one coupling post for joining together a plurality of non-aligned walls, said coupling post including a plurality of coupling surfaces, each said coupling surface being in abutting engagement with one of said struts, so that one strut of each joined wall is engaged by one of said coupling surfaces, and further including fastening means for securing together said engaged struts and coupling surfaces.

26. A wall system as defined in claim 1 further including a pair of aligned walls and at least one joining bracket for joining together the pair of aligned walls, said joining bracket including an L-shaped member having a strut plate and a rail plate, said strut plate being attached to a strut of one of said walls and said rail plate being attached to a rail of the other wall.

27. A wall system as defined in claim 26 further including a pair of joining brackets for connecting the pair of adjacent aligned walls, wherein one joining bracket is attached to the top rail of said other wall and the other joining bracket is attached to the bottom rail of said other wall.

28. A wall system as defined in claim 1 further including a plurality of decorative covers which can be releasably snap-fit on each of said struts.

29. A wall system as defined in claim 28 in which each said strut has a substantially C-shaped cross-sectional configuration including a pair of side segments defining a gap therebetween, and in which each said cover is a unitary resilient member which substantially encircles one of said struts and includes locking segments which interlock with said side segments of said strut in said defined gap.

30. A wall system as defined in claim 28 in which each said strut includes a side wall having an inwardly offset central portion which defines a pair of shoulders, and in which each said cover is a unitary resilient member which substantially encircles one of said struts and includes locking segments which interlock with said shoulders of said strut to secure said cover to said strut.

31. A wall system as defined in claim 28 in which each said strut has a substantially C-shaped cross-sectional configuration including front and rear walls extending substantially parallel to said rails, a pair of side segments extending laterally to said rails and defining a gap therebetween, and a side wall opposite said side segments which includes an inwardly offset central portion defining a pair of shoulders, and in which each said cover is a unitary resilient member which surrounds substantially one-half of one of said struts and includes a pair of locking segments, wherein one locking segment interlocks with one of said side segments of said strut in said defined gap and the other locking segment interlocks with one of said shoulders defined on said side wall of said strut.

32. A wall system as defined in claim 3 in which said block has a configuration which substantially corresponds in shape with said U-shaped central portion of said bottom rail.

33. A wall system as defined in claim 11 in which said block has a configuration which substantially corresponds to the shape of said channel in said bottom rail.

34. A wall system comprising:

an elongated horizontal top rail having a longitudinal axis;

an elongated horizontal bottom rail having a longitudinal axis;

a plurality of vertical struts interconnecting said rails;

a plurality of display panels, each panel being positioned between said top and bottom rails and between a pair of adjacent struts, and each panel being further positioned to be substantially aligned with said longitudinal axes of said top and bottom rails; and frame means for releasably attaching each said display panel to said top and bottom rails, said frame means having an upper frame attached to said top rail and a lower frame attached to said bottom rail, each said frame including a main member attached to the corresponding rail and defining a first retaining segment, and an attachment releasably attached to said main member and defining a second retaining segment, said first and second retaining segments collectively defining a channel for receiving and retaining said display panel when said attachment is attached to said main member, each said main member further including a pair of attaching segments defining a gap therebetween, and each said attachment further including a projecting segment adapted to be matingly received within said gap to releasably attach said attachment to said main member, said projecting segment including a plurality of flexible barbs adapted to releasably secure said projecting segment within said gap.

35. A wall system comprising:

a top horizontal rail;

a bottom horizontal rail;

a plurality of vertical struts interconnecting said rails, each said strut having a substantially C-shaped cross-sectional configuration including a pair of side segments defining a gap therebetween; and a plurality of decorative covers which can be releasably snap-fit on each of said struts, wherein each said cover is a unitary resilient member which substantially encircles one of said struts and includes locking segments which interlock with said side segments of said strut in said defined gap.

36. A wall system comprising:

a top horizontal rail;

a bottom horizontal rail;

a plurality of vertical struts interconnecting said rails, each said strut having a substantially C-shaped cross-sectional configuration including front and rear walls extending substantially parallel to said rails, a pair of side segments extending laterally to said rails and defining a gap therebetween, and a side wall opposite said side segments including an inwardly offset central portion defining a pair of shoulders; and a plurality of decorative covers which can be releasably snap-fit on each of said struts, wherein each said cover is a unitary resilient member which surrounds substantially one-half of one of said struts and includes a pair of locking segments, wherein one locking segment interlocks with one of said side segments of said strut in said defined gap and the other locking segment interlocks with one of said shoulders defined on said side wall of said strut.

* * * * *